United States Patent [19]

Shiibayashi et al.

[11] Patent Number: 4,579,512

[45] Date of Patent: Apr. 1, 1986

[54] SCROLL-TYPE FLUID MACHINE WITH RADIAL CLEARANCE BETWEEN WRAPS

[75] Inventors: Masao Shiibayashi, Shimizu; Sumihisa Kotani, Ibaraki; Kazutaka Suefuji, Shimizu; Kenji Tojo, Ibaraki; Akira Murayama, Shimizu, all of Japan

[73] Assignee: Hitachi, Ltd., Tokyo, Japan

[21] Appl. No.: 661,915

[22] Filed: Oct. 17, 1984

[30] Foreign Application Priority Data

Oct. 18, 1983 [JP] Japan ..... 58-193485

[51] Int. Cl.[4] ..... F01C 1/04; F01C 17/06

[52] U.S. Cl. ..... 418/55; 418/178

[58] Field of Search ..... 418/55, 57, 59

[56] References Cited

U.S. PATENT DOCUMENTS 4,082,484 4/1978 McCullough ..... 418/55
4,365,941 12/1982 Tojo et al. ..... 417/372
4,382,754 5/1983 Shaffer et al. ..... 418/55

FOREIGN PATENT DOCUMENTS 58-110887 7/1983 Japan ..... 418/55

*Primary Examiner*—John J. Vrablik
*Attorney, Agent, or Firm*—Antonelli, Terry & Wands

[57] ABSTRACT

A scroll-type fluid machine having a stationary scroll member and an orbiting scroll member each of which includes a disc-like end plate and a spiral wrap extending axially from one side of the end plate, with the wraps of the scroll members meshing with each other to define therebetween closed compression chambers. The orbiting scroll member is disposed between the end plate of the stationary scroll member and a frame of the machine with a back clearance between the other side of the end plate of the orbiting scroll member side thereof and the opposing surface of the frame. The orbiting scroll member is driven to make an orbiting movement with respect to the stationary scroll member so that the compression chambers are progressively moved towards the center of the scroll members while decreasing their volumes, to thereby suck a fluid through a suction port in the stationary scroll member and compress the same to discharge the compressed fluid through a discharge port formed in the stationary scroll member. The radial clearance between the wraps of both scroll members is selected to meet a specific condition so as to avoid mutual contact between the wraps of the scroll members even when the orbiting scroll member is inclined with respect to the horizontal plane.

3 Claims, 21 Drawing Figures

SCROLL-TYPE FLUID MACHINE WITH RADIAL CLEARANCE BETWEEN WRAPS

BACKGROUND OF THE INVENTION

The present invention relates to an oil-lubricated scroll-type fluid machine suitable for use as a refrigerant compressor for an air conditioner or a refrigerator, as well as an air compressor and, more particularly, to a scroll-type fluid machine in which a predetermined clearance is intentionally formed between the side surfaces of wraps of a stationary scroll member and an orbiting scroll member.

In, for example, U.S. Pat. No. 4,082,484 a scroll-type machine, serving as a compressor, is proposed which includes a stationary scroll member and an orbiting scroll member each of which has an end plate and a wrap formed along an involute curve or a curve simulating an involute curve so as to extend upright from one side of the end plate. The scroll members are assembled together in a housing such that the wraps thereof mesh each other, with a suction port and a discharge port formed in a central portion and a peripheral portion of the end plate of the stationary scroll member and communicating with a suction pipe and a discharge pipe connected to the housing, respectively.

An Oldham's ring adapted, for preventing the orbiting scroll member from rotating about its own axis, is disposed between the orbiting scroll member and the frame of the machine or the stationary scroll member. The orbiting scroll member is driven by a main shaft engaging therewith, so as to execute an orbiting movement with respect to the stationary scroll member without rotating about its own axis, such that the volumes of closed chambers formed between the wraps of two scroll members are progressively decreased, thereby compressing a gas confined in these chambers and discharging the compressed gas from the discharge port.

From the view point of minimization of wear or abrasion the wrap side surfaces, it is desirable that a minute clearance be maintained between the opposing side surfaces of the wraps of both scroll members, i.e., that the opposing side surfaces of the wraps of both scroll members do not directly contact each other, during the operation of the compressor.

If the scroll members are precisely machined in conformity with the theoretical design, the orbiting scroll member will make an ideal orbiting movement on a circle of a radius conforming with the theoretical radius without making any vertical oscillation, so that undesirable axial displacement of the orbiting scroll member, which may result from an inclination of the orbiting scroll member is advantageously avoided.

Actually, however, different phases of the scroll members provide different sizes of radial clearance between the wraps of both scroll members because of tolerances in machining of the scroll members.

During the operation of the scroll compressor, a force is generated by the pressure of the gas under compression in the compression chambers formed between the stationary scroll member and the orbiting scroll member. This force is divided into an axial force component which tends to separate the orbiting scroll member downwardly from the orbiting scroll member and a radial component which resists the driving torque exerted by the main shaft. On the other hand, a counter force which balances the radial component is exerted on the eccentric shaft portion of the driving main shaft so as to act in the direction opposite to the radial component. On the other hand, an intermediate gas pressure, established in a back pressure chamber formed behind the orbiting scroll member, generates a force acting on the rear side of the orbiting scroll member. Consequently, a moment of force is generated due to a discordance between the point of application of the radial component and the point of application of the counter force.

During the operation of the scroll compressor, the moment of force causes an inclination of the orbiting scroll member, allowing a mutual contact between the wraps of both scroll members resulting in a rapid wear of the wraps or, in the worst case, a breakdown of the wraps of both scroll members.

In order to avoid the occurrence of an undesirable inclination of the orbiting scroll member, in, for example, Japanese Patent Laid-Open No. 110887, the axial clearance at the outer periphery of the end plate of the orbiting scroll member is so determined as to avoid any local contact between the end surface of the eccentric shaft portion of the driving main shaft and the orbiting bearing receiving this eccentric shaft portion. Thus, in this prior art, the radial clearance at the peripheral portion of the end plate of the orbiting scroll member is regulated with respect to the outside diameter of the end plate of the orbiting scroll member, clearance in the orbiting bearing and the length of the orbiting bearing.

SUMMARY OF THE INVENTION

Accordingly, an object of the invention is to provide a scroll-type fluid machine wherein a size of the radial clearance between the wraps of the orbiting scroll member and the stationary scroll member is so selected so as to prevent mutual contact between the wraps of both scroll members, while maintaining the necessary amount of offset of the driving main shaft, even when the orbiting scroll member is inclined during operation of the machine.

Another object of the invention is to provide a scroll-type fluid machine wherein the inclination of the orbiting scroll member is limited to maintain the radial clearance between the wraps of both scroll members.

To these ends, according to the invention, the back clearance $\delta_h$ at the peripheral portion of the end plate of the orbiting scroll member is selected to satisfy the following conditions:

$$\delta_h < (\Delta\epsilon \pm \Delta S_1 \pm \Delta S_2)Dm/hm$$

or $$\delta_h < \Delta\epsilon \cdot Dm/hm$$

where, $\Delta\epsilon$: amount of offset of main shaft, $\Delta S_1$, $\Delta S_2$: radial precision of wraps of scroll members, Dm: outside diameter of orbiting scroll member, and hm: height of scroll wrap.

According to the invention, a scroll-type fluid machine is provided, wherein the back clearance $\delta_h$ is determined to be as small as the bearing clearance so that the dimensionless value $\delta_h^*$ of the back clearance satisfies the following:

$$\delta_h^* \leqq 1.0 \times 10^{-3}$$

where, $\delta_h^*$: $\delta_h$/Dm.

Thus, according to the invention, the size of the back clearance $\delta_h$ is selected in relation to the factors such as the height hm of the wrap, outside diameter Dm of the end plate and so forth, so as to maintain a clearance between the opposing side surfaces of the wraps of two scroll members thereby avoiding undesirable mutual contact between the wraps of both scroll members, without necessitating any increase of the amount of offset of the driving main shaft, thus attaining a higher performance and reliability of the scroll-type fluid machine.

Namely, by limiting the amount of axial displacement of the orbital scroll member through the limiting of the back clearance in the scroll-type fluid machine, it is possible to suppress the inclination of the orbiting scroll member with respect to the horizontal plane, thus limiting the amount of radial displacement of the orbiting scroll member, thereby preserving a radial clearance between the wraps of both scroll members. Consequently, the undesirable mutual contact between the wraps of both scroll members is avoided to eliminate troubles such as a breakdown of the wraps often experienced in the known scroll-type fluid machine, while improving the durability and reliability of the machine.

In addition, the minimized inclination of the end plate of the orbiting scroll member eliminates any non-uniform or local contact and a consequential frictional power loss in the orbiting bearing and eliminates troubles such as a seizure in the orbiting bearing, thus improving the durability and reducing the power consumption.

It is to be noted also that, since the radial contact between the wraps of both scroll members can be avoided without increasing the amount of offset of the driving main shaft, it is possible to avoid any increase in the axial clearance between two scroll members. Consequently, the internal leak of the fluid in the machine is minimized to ensure a higher performance of the machine through increase in the suction rate and volumetric efficiency.

BRIEF DESCRIPTION OF THE DRAWINGS

The invention will be fully understood from the following description of the preferred embodiments when the same is read in conjunction with the accompanying drawings in which.

DESCRIPTION OF THE PREFERRED EMBODIMENTS

Figure 1:
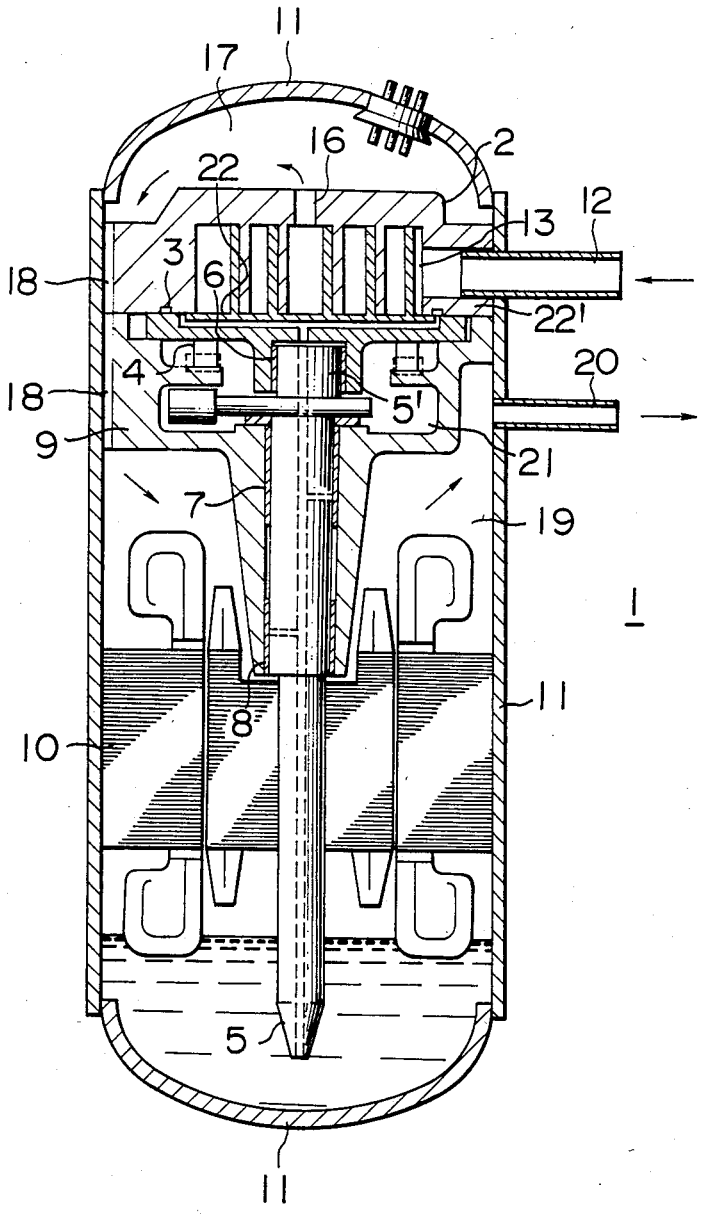
FIG. 1 PRIOR ART
FIG. 1 is a vertical sectional view of a hermetic scroll compressor to which the present invention can be applied.
Figure 2:
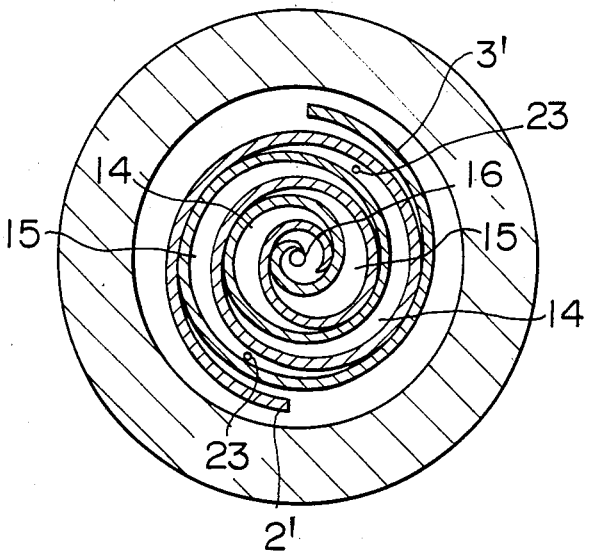
FIG. 2 PRIOR ART
FIG. 2 is a cross-sectional view of the hermetic scroll compressor shown in FIG. 1, illustrating particularly the state of meshing of the wraps of two scroll members.

Referring now to the drawings wherein like reference numerals are used throughout the various views to designate like parts and, more particularly, to FIGS. 1 and 2, according to these figures, a hermetic scroll compressor 1 has a vertically elongated structure which includes a compressor section disposed in the upper part thereof, a motor section disposed in the lower part thereof and a hermetic housing 11 for housing the compressor and the motor section therein. The compressor section has a stationary scroll member 2 and an orbiting scroll member 3 which, in combination, constitute compressor elements, a member 4 for preventing the orbiting scroll member 3 from rotating about its own axis, and a main shaft 5 which has an eccentric or crankshaft portion 5' engaging the orbiting scroll member 3. The main shaft 5 is supported by three bearings including an orbiting bearing 6, fixed on the orbiting scroll member 3 and receiving the end of the crankshaft portion 5' of the main shaft 5, a main bearing 7, and an auxiliary bearing 8 disposed beneath the main bearing 7. The main bearing 7 and the auxiliary bearing 8 are fixed to a frame 9. The motor section disposed in the lower portion of the hermetic housing 11 includes an electric motor 10 having a stator secured to the wall of the housing 11 and a rotor the shaft of which constitutes the lower end portion of the main shaft 5.

The hermetic scroll compressor shown in FIG. 1 is of a high-pressure chamber type in which the space in the hermetic housing 11 is maintained under the high pressure, i.e., the discharge pressure of the compressor. The wraps of the scroll members are formed in conformity with involute curves or curves simulating the involute curves, with the arrows in FIG. 1 indicating the directions of flow of the gas in the compressor.

The operation of the hermetic compressor 1 will be explained in accordance with the flow of a refrigerant gas to be compressed; however, a description concerning the flow of lubricating oil is omitted. The refrigerant gas of a low temperature and pressure is sucked through a suction pipe 12 formed in the end plate 22' of the stationary scroll member 2 and is introduced into a suction chamber 13 formed in the stationary scroll member 2. The gas is then induced into closed chambers 14, 15 formed between the wraps 2', 3' of both scroll members 2, 3 (FIG. 2). As a result of an orbiting movement of the orbiting scroll member 3 relative to the stationary scroll member 2, the chambers 14 and 15 are shut off and are gradually moved towards the center of the scroll members 2, 3 while progressively decreasing their volumes. Consequently, the refrigerant gas is pressurized and discharged through the discharge port 16 formed in the center of the stationary scroll member 2. The refrigerant gas thus compressed to a high pressure and temperature is introduced into a space 19 around the electric motor 10 through a space 17 defined in the upper portion of the hermetic housing 11 and through a passage 18 defined between the wall of the hermetic housing 11 and the stationary scroll member 2 and the frame 9. The gas is then discharged to the outside at a high discharge pressure Pd through a discharge pipe 20.

The pressure of the gas compressed in the closed compression chambers defined between both scroll members 2, 3 produces an axial thrust force which tends to urge the orbiting scroll member 3 downwardly away from the stationary scroll member 2. A pressure Pm, intermediate between the suction pressure (low pressure) and the discharge pressure, is established in a back pressure chamber 21 defined between the rear face of the orbiting scroll member 3 and the frame 9, so as to produce a force which resists the force urging the orbiting scroll member 3 away from the stationary scroll member 2.

As disclosed in U.S. Pat. No. 4,365,941, intermediate pressure is introduced into the back pressure chamber 21 from closed compression chambers moving in their midway between the suction and discharge positions through fine apertures 23 (FIG. 2) formed in the end plate 22 of the orbiting scroll member 3.

In order to facilitate the understanding of embodiments which will be explained in connection with FIG. 9 and subsequent Figures, an explanation will be made hereinunder with specific reference to FIGS. 3 to 8 as to the relationship between the radial clearance between the wraps of both scroll members and the amount of offset of the main shaft, as well as problems incurred by such a relationship.

Figure 3:
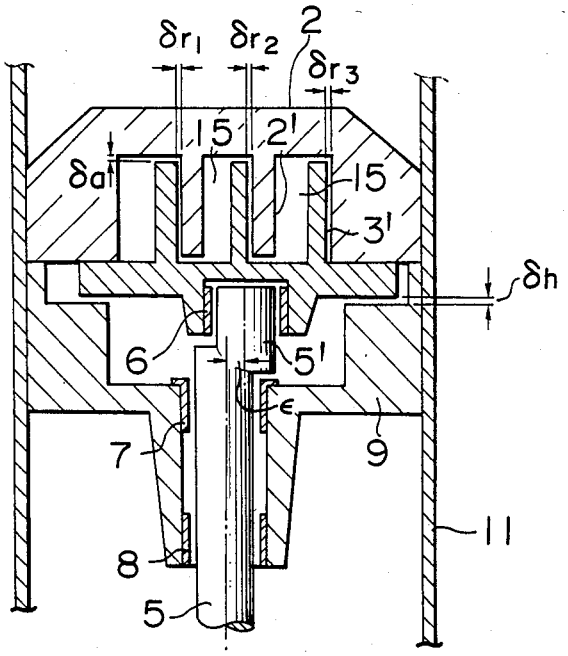
FIG. 3 PRIOR ART
FIG. 3 is a vertical sectional view showing the positional relationship between the orbiting scroll member and the frame of the compressor.
Figure 4:
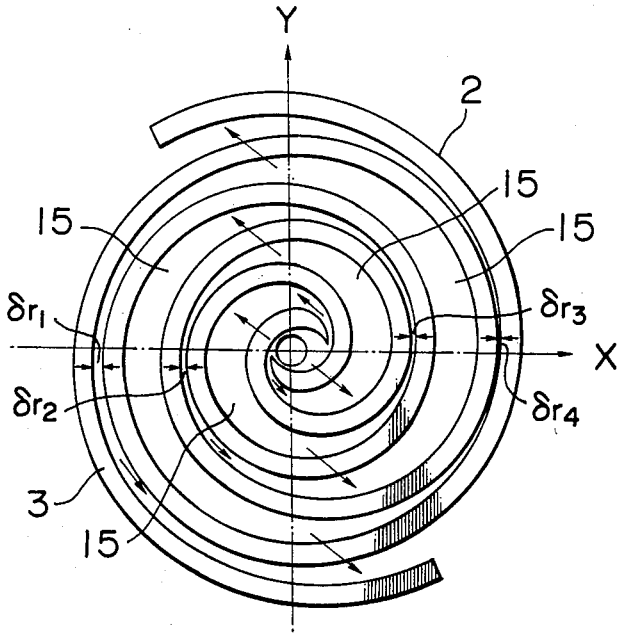
FIG. 4 PRIOR ART
FIG. 4 is an illustration of the clearance between the wraps of the scroll members.

FIGS. 3 and 4 show the portions of the scroll compressor 1 where the internal leak of the fluid under compression in the compression chamber 15 occurs, as well as the directions of flow of the leaking fluid. Generally, the internal leak of the fluid takes place at two portions, namely, through the axial clearance $\delta_a$ between the axial end surfaces of the wraps 2', 3' and the opposing surfaces of the end plates, and through the radial clearances $\delta_r$ between the opposing side surfaces of the wraps 2', 3'.

The radial clearances are indicated by δr1, δr2 and δr3 in FIG. 3, and by δr1, δr2, δr3 and δr4 in FIG. 4. These radial clearances δr1 to δr4 are those which obtained when the orbiting scroll member 3 makes an ideal orbiting motion. In this ideal state, the orbiting scroll member 3 makes an orbiting movement in parallel with the stationary scroll member 2, and the undesirable inclination of the orbiting scroll member 3 which causes an axial displacement of the orbiting scroll member 3, does not take place.

If the scroll members 2, 3 are precisely machined and finished in accordance with the theoretical design, the orbiting scroll member 3 makes the ideal orbiting movement on a circle having a radius δth.

However, in practice, in order to absorb any tolerance which may be involved in the machining, the amount of eccentricity of the crankshaft portion 5' of the main shaft 5, i.e., the actual radius of the circle on which the orbiting scroll member 3 moves, is selected to be ϵ which is smaller than the theoretical radius ϵth by an amount equal to the amount Δϵ of offset of the main shaft.

Namely, the values Δϵ, ϵth and ϵ satisfy the following condition:

$$\Delta\epsilon = \epsilon th - \epsilon \quad (1)$$

where,

Δϵ: amount of offset of main shaft,

ϵth: theoretical radius of orbital movement, and

ϵ: eccentricity of crankshaft portion 5' (actual radius of orbital movement).

In the actual compressor, the different phases of th wraps provide different radial clearances δr, due to the tolerance involved in the machining of the side surfaces of the wraps 2', 3'.

Figure 5:
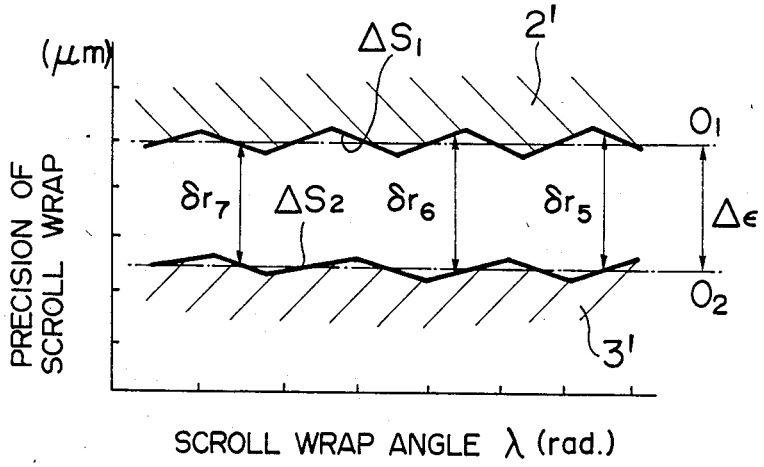
FIG. 5 PRIOR ART
FIG. 5 is a graph showing the relationship between the radial clearance between the wraps of both scroll members and the amount of offset of the driving main shaft, as well as the precision of the wrap contour.

FIG. 5 shows an example of change in the radial clearance δr in relation to the phases of the wraps 2', 3' of the scroll members 2, 3. In FIG. 5, the axis of abscissa represents the scroll wrap angle λ which is, in this case, the involute angle of an involute.

The upper hatched area in FIG. 5 shows the side surface, e.g., inner side surface, of the wrap 2' of the stationary scroll member 2, whereas, the lower hatched area represents the side surface of the wrap 3' of the orbiting scroll member 3, e.g., the outer side surface of the wrap 3' opposing to the above-mentioned inner surface of the wrap 2'.

A symbol $\Delta S_1$ indicates the degree of precision, i.e., the amount of radial tolerance of the machining of the side surface of the wrap 2' of the stationary scroll member 2, while $\Delta S_2$ represents the degree of precision, i.e., the amount of radial tolerance of the machining of the side surface of the wrap 3' of the orbiting scroll member 3, and axes $O_1$, $O_2$ represent the theoretical precision of the side surfaces of the wraps of the scroll members, respectively. The radial clearance between the side surfaces of the wraps machined with the precision of $\Delta S_1$ and $\Delta S_2$ is the radial clearance δr between both scroll wraps 2' and 3' as obtained when the orbiting scroll member 3 makes an ideal orbiting movement.

From FIG. 5, it is understood that the radial clearance $\delta_r$ between both wraps 2' and 3' when the orbiting scroll member 3 executes an ideal orbiting movement is generally given by the following formula:

$$\delta_r = \Delta\epsilon \pm \Delta S_1 \pm \Delta S_2 \quad (2)$$

The varying clearance is represented by δr5, δr6 and δr7 in FIG. 5.

As explained above, the pressure of the gas confined and compressed in the compression chambers 15, formed between both scroll members 2, 3, produce an axial force which is divided mainly into an axial force component Fa which tends to move the orbiting scroll member 3 downwardly away from the stationary scroll member 2 and a radial force component Ft which acts in the direction counter to the torque of the main shaft 5. At the same time, a driving force R which balances the radial component Ft acts on the crankshaft portion 5' in the direction counter to the force component Ft.

On the other hand, the above-mentioned intermediate pressure Pm, acting in the back pressure chamber 21, produces a back pressure force Fb which acts on the back side of the end plate 22 of the orbiting scroll member 3.

Since the point of application of the radial force component Ft is spaced from the point of application of the driving force R, a moment of force Mo given by the following formula (3) is applied to the orbiting scroll member 3:

$$M_o = Ft \times l_s \tag{3}$$

where $l_s$ represents the distance between the point of application of the radial force component Ft and the point of application of the driving force R.

This moment of force $M_o$ exists regardless of whether the operation of the compressor is in the transient condition or in the steady state condition, tending to incline the orbiting scroll member 3 at a certain angle $\theta_m$.

Figure 6:
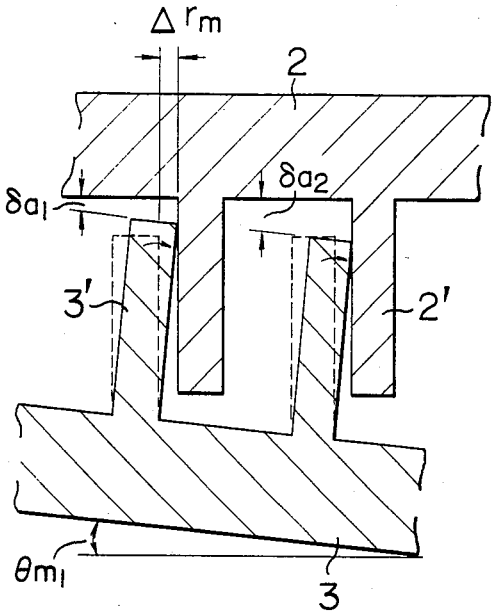
FIG. 6 PRIOR ART
FIG. 6 is a vertical sectional view illustrating the change in the clearance between the wraps of two scroll members.

Referring to FIG. 6, when the orbiting scroll member 3 is inclined from the position shown by broken line to the position shown by full line to provide the radial displacement $\Delta r_m$, e.g., at an inclination angle $\theta_m$, the end of the wrap 3' of the orbiting scroll member 3 approaches the wrap 2' of the stationary scroll member 2. As the inclination angle $\theta_m$ increases, the wrap 3' of the orbiting scroll member 3 is brought into contact with the wrap 2' of the stationary scroll member 2. More specifically, FIG. 6 shows the orbiting scroll member 3 inclined at an angle $\theta_{m1}$ so that the end of the wrap 3' thereof undesirably contacts the wrap 2' of the stationary scroll member 2. As a result of the inclination of the orbiting scroll member 3 at the inclination angle $\theta_{m1}$, the end plate 22 of the orbiting scroll member 3 is displaced axially by a distance $W_m$, while the wrap 3' of the same contacts the wrap 2' of the stationary scroll member 2.

Figure 7:
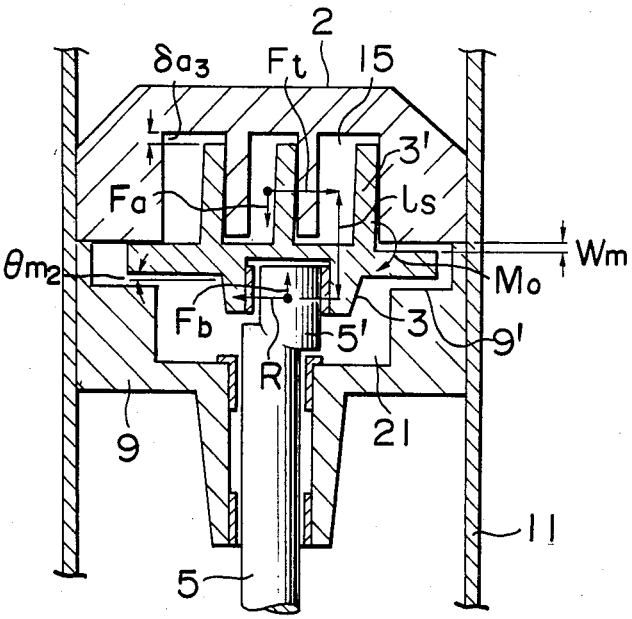
FIG. 7 PRIOR ART
FIGS. 7 and 8 are illustrations of radial clearance $\delta_r$ ($\delta$rm) between the scroll wraps.
Figure 8:
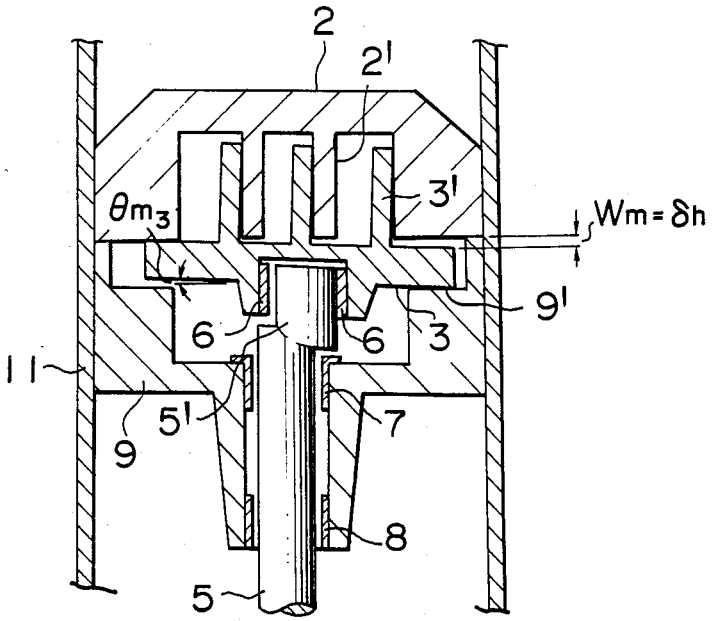
FIG. 8 PRIOR ART

In FIG. 7, the orbiting scroll member 3 is inclined at a greater angle $\theta_{m2}$ than the angle $\theta_{m1}$, i.e., $\theta_{m1} < \theta_{m2}$, so that the rear face of the end plate 22 of the orbiting scroll member 3 comes near to a seat portion 9' provided by the frame 9 and lastly comes into therewith as shown in FIG. 8, while the wraps 2', 3' of both scroll members 2, 3 abut each other more strongly. Symbols $\delta_{a1}$, $\delta_{a2}$ in FIG. 6 and symbols $\delta_{a3}$ in FIG. 7 represent the respective axial clearances between the axial end surfaces of the wraps and the opposing surfaces of the end plates when the orbiting scroll member 3 is inclined. This behavior of the orbiting scroll member 3 is observed in the steady state operation of the scroll compressor, which includes the operation at high pressure region in which the ratio $\pi$ of the discharge pressure Pd to the suction pressure Ps becomes higher, for instance, in a range of from 5 to 10.

FIG. 8 shows a state which is observed immediately after the starting of the scroll compressor 1 or when the compressor operates in a state called "liquid back" or "liquid compression" in which the refrigerant in the liquid phase is sucked into the suction chamber 13.

In the state shown in FIG. 8, the end plate 22 of the orbiting scroll member 3 is inclined at angle $\theta_{m3}$ and is displaced axially to completely eliminate a back clearance $\delta_h$ between the rear face of the end plate 22 and the opposing frame 9. Namely, in this state. the axial displacement $W_m$ of the peripheral portion of the end plate 22 becomes equal to the back clearance $\delta_h$. The contact between the wraps 2', 3' of both scroll members 2, 3 is strongest in the state shown in FIG. 8.

In FIGS. 7 and 8, the radial displacements $\Delta r_{m1}$ and $\Delta r_{m2}$ of the wraps 2', 3' due to the inclination of the orbiting scroll member 3 are given by the following formulae:

$$\begin{aligned}\Delta r_{m1} &= h_m \cdot \theta_{m1} \\ &\approx h_m \cdot W_m/D_m\end{aligned} \tag{4}$$

$$\begin{aligned}\Delta r_{m2} &= h_m \cdot \theta_{m2} \\ &\approx h_m \cdot \delta_h/D_m\end{aligned} \tag{5}$$

where, $h_m$ represents the height of the scroll wrap, and $D_m$ represents the outside diameter of the end plate 22 of the orbiting scroll member 3.

It will be understood that, in the operation of the scroll compressor 1, the radial clearance $\delta r$ between the scroll wraps 2', 3' cannot be evaluated by the formula (2).

Namely, in the actual operation of the scroll compressor, it is necessary to evaluate the radial clearance (minimum clearance) $\delta r_m$ between the wraps 2', 3' taking into account also the amount of radial displacement $\Delta r_m$ of the scroll wraps 2', 3'. The minimum radial clearance $\delta r_m$ can be approximately given by the following formula:

$$\delta r_m = \Delta\epsilon \pm \Delta S_1 \pm \Delta S_2 - \Delta r_m \tag{6}$$

where, $\Delta r_m$ represents the amount of radial displacement of the wraps 2', 3' caused by the inclination of the orbiting scroll member 3.

It will be seen that, in the states shown in FIGS. 7 and 8, the value of the radial clearance $\delta r_m$ in formula (6) satisfy the following condition.

$$\delta_{rm} = 0 \tag{7}$$

When the contact between both scroll wraps 2', 3' is made more strongly, the condition is as follows.

$$\delta_{rm} < 0 \tag{8}$$

It is assumed here that the amount $\Delta\epsilon$ of offset of the main shaft is 40 $\mu$m, the back clearance $\delta_h$ is about 100 $\mu$m, the outside diameter $D_m$ of the end plate is 100 mm and the wrap height $h_m$ is 40 mm. In this case, the displacement $\Delta r_{m2}$ is calculated to be about 40 $\mu$m from the formula (5). In the case that the wraps are finished in the ideal state to meet the condition of $\Delta S_1 \approx \Delta S_2 \approx 0$, the value $\delta r_m$ is calculated to be 0 from the formula (6).

Therefore, taking the tolerances $\Delta S_1$, $\Delta S_2$ into account, it is quite credible that the condition of $\delta_{rm} < 0$($\delta_r < 0$) is met.

In formula (6), assuming the condition of $\delta_{rm} > 0$ and assuming that the amount $\Delta\epsilon$ of offset of the main shaft is increased from 40 $\mu$m to 80 $\mu$m to avoid the mutual contact between two wraps 2', 3', the radial clearance between both wraps 2', 3' itself is increased. Such an increased radial clearance does not constitute any measure for eliminating the reduction of performance of the compressor due to the internal leak of the fluid.

If the wraps 2' and 3' of both scroll members 2, 3 are held in contact with each other continuously during the operation of the compressor as shown in FIGS. 6 to 8, the mechanical frictional loss is increased to require a greater driving power for driving the compressor 1. In addition, the axial displacement of the orbiting scroll member 3 causes an increase in the axial clearances between the end surfaces of the scroll wraps 2', 3' of both scroll members 2, 3 and opposing end plates. Although this increase in the axial clearnce is small, this inconveniently increases the internal leak of the fluid and decreases the volumetric efficiency to adversely affect the suction capacity of the compressor.

Moreover, in the state shown in FIG. 8 in which the orbiting scroll member 3 is inclined largely to make the wraps 2', 3' of both scroll members 2, 3 contact at high pressure, there is a fear that the wraps 2', 3' will be damaged due to an excessive mechanical stress, thus impairing the reliability of the compressor.

The inclination of the orbiting scroll member 3 causes another problem. Namely, when the orbiting scroll member 3 is inclined as shown in FIGS. 7 and 8, the eccentric crankshaft portion 5' and the orbiting bearing 6 makes an uneven contact resulting in causing an increased frictional loss of power. The extent of the uneven contact is enhanced in proportion to the inclination angle $\theta_m$, often resulting in a seizure of the crankshaft portion 5' in the orbiting bearing 6.

Figure 9:
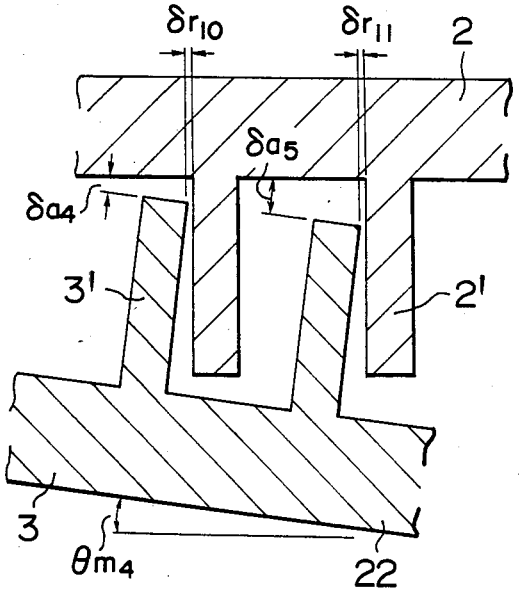
FIG. 9 is a vertical sectional view of a scroll fluid machine of the invention, showing the radial clearance between the wraps of two scroll members.

As shown in FIG. 9, the end plate 22 of the orbiting scroll member 3 is inclined at an angle $\theta_{m4}$ and is displaced in the axial direction fully to negate the back clearance $\delta_h$. It is also shown that the radial clearances between both scroll wraps 2', 3' is given by $\delta_{r10} \approx \delta_{r11} > 0$, with $\delta_{a4}$, $\delta_{a5}$ representing the axial clearances between the axial end surfaces of the wraps 2',3' and the opposing surfaces of the end plates, respectively.

Figure 10:
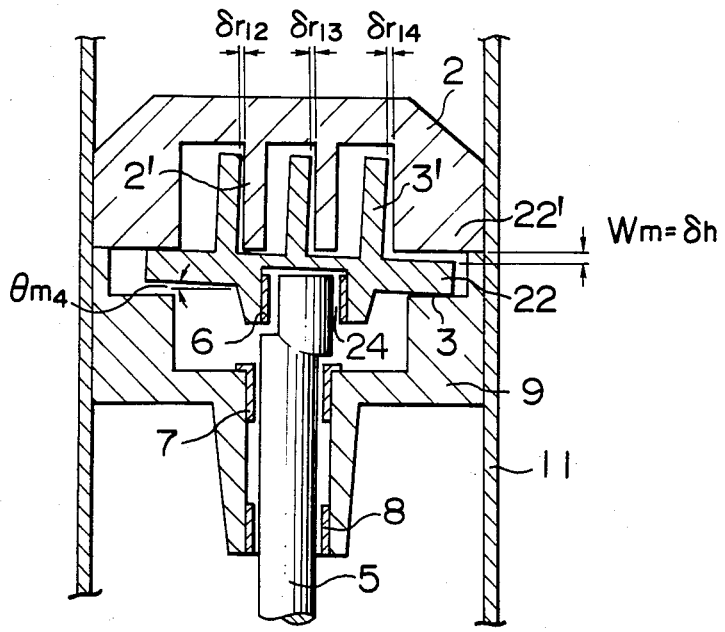
FIG. 10 is a vertical sectional view illustrating the positional relationship between the stationary scroll member and the orbiting scroll member.

As shown in FIG. 10, the back clearance $\delta_h$ at the outer peripheral portion of the end plate 22 of the orbiting scroll member 3 is determined to meet the condition of formula (10), so that the radial clearance $\delta_{rm}$ between the wraps 2', 3' of both scroll members 2, 3 meet the condition of the following formula (9):

$$\delta_{rm} = \Delta\epsilon \pm \Delta S_1 \pm \Delta S_2 - \Delta r_m > 0 \quad (9)$$

$$\delta_h < (\Delta\epsilon \pm \Delta S_1 \pm \Delta S_2) D_m / h_m \quad (10)$$

where, $\Delta\epsilon$: amount of offset of main shaft ($=\epsilon th - \epsilon$), $\Delta S_1$: radial precision of wrap 2' of stationary scroll member, $\Delta S_2$: radial precision of wrap 3' of orbiting scroll member 3, $D_m$: outside diameter of end plate 22 of orbiting scroll member 3, $h_m$: height of scroll wrap.

When the condition given by formula (11) is met in connection with the precision of the wraps 2', 3' of the stationary and orbiting scroll members 2, 3, the formulae (9) and (10) are rewritten as formulae (12) and (13).

$$\Delta S_1 \approx \Delta S_2 \approx 0 \quad (11)$$

$$\delta_{rm} = \Delta\epsilon - \Delta_{rm} > 0 \quad (12)$$

$$\delta_h < \Delta\epsilon \cdot D_m / h_m \quad (13)$$

Therefore, in the embodiment shown in FIG. 10, the inclination angle $\theta_{m4}$ of the end plate 22 of the orbiting scroll member 3 is as follows.

$$\theta_{m4} \approx \delta_h / D_m \quad (14)$$

In FIG. 10, symbols $\delta_{r12}$, $\delta_{r13}$ and $\delta_{r14}$ represent the radial clearances between the both scroll wraps 2', 3', respectively, when the end plate 22 of the orbiting scroll member 3 comes into contact with the seat portion 9' of the frame 9 as a result of the inclination of the orbiting scroll member.

The advantage of the invention will be explained with making use of practical numerical values, for the comparison with the prior art. It is assumed here that the amount $\Delta\epsilon$ of offset of the main shaft is 40 $\mu$m and that the back clearance $\delta_h$ is 60 $\mu$m to realize the condition of $\delta_{rm} > 0$.

In this case, the value $\Delta r_m$ is calculated from the formula (5) as follows.

$$\Delta r_m = 40 \times 0.06/100 \approx 0.024$$

Thus, the amount of radial displacement of the wrap 3' of the orbiting scroll member 3 is calculated to be 24 $\mu$m.

Substituting this value for $\Delta r_m$ of the formula (12), it is understood that the condition of $\delta_{rm} > 0$ is met as follows.

$$\delta r_m = 40\ \mu m - 24\ \mu m = 16\ \mu m$$

Consequently, in this case, the radial clearances $\delta_{r10}$ and $\delta_{r11}$ exist between both scroll members 2, 3 in spite of the inclination of the orbiting scroll member 3. At the same time, a clearance 24 exists between the crankshaft portion 5' of the main shaft 5 and the orbiting bearing 6 to prevent any uneven contact therebetween, despite the inclination of the orbiting scroll member 3 at the inclination angle $\theta_{m4}$. This clearance 24 holds a lubricating oil film strong enough to bear the load exerted by the driving force R.

Figure 11:
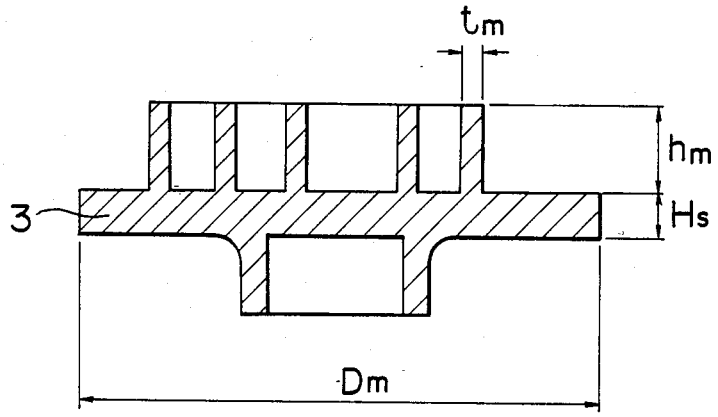
FIG. 11 is a vertical sectional view of the orbiting scroll member.
Figure 12:
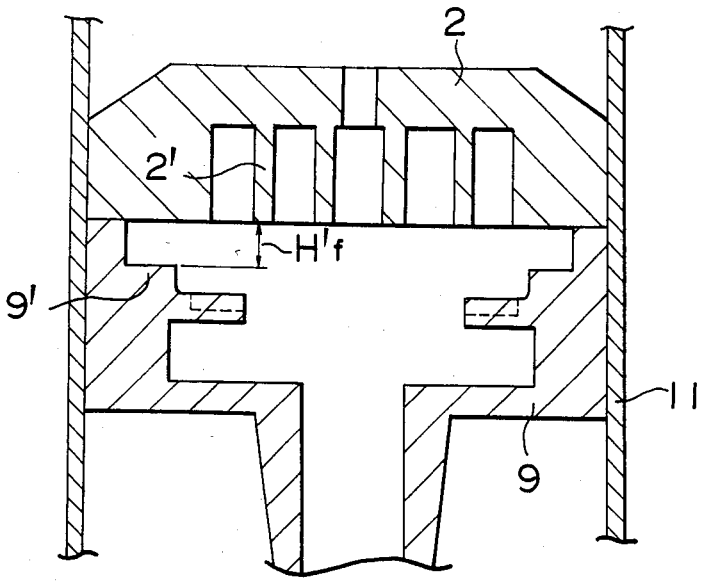
FIG. 12 is a vertical sectional view of the stationary scroll member and the frame.
Figure 13:
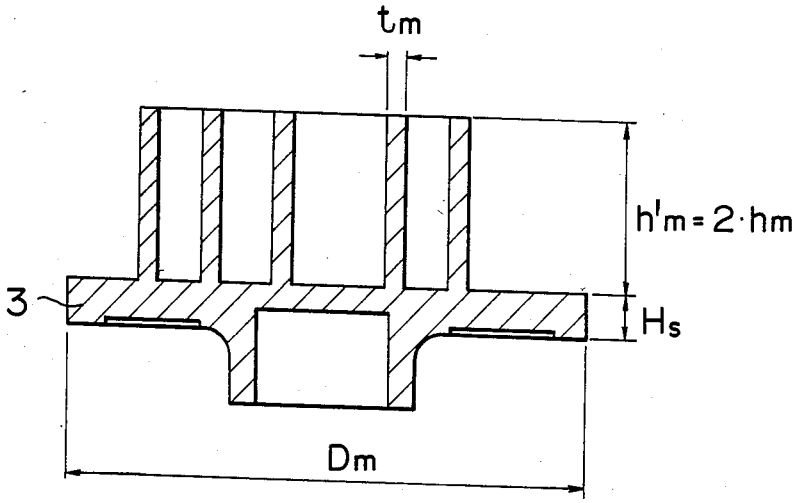
FIG. 13 is a vertical sectional view of another example of an orbiting scroll member.

FIGS. 11 to 13 show embodiments which are designed to have different heights $h_m$ of the wrap 3' of the orbiting scroll member 3. The orbiting scroll member 3 as shown in FIG. 13, has a height $h_m'$ which is twice as large as the wrap height $h_m$ of the orbiting scroll member 3 shown in FIG. 11. In order to avoid mutual contact of the side faces of the wraps 2', 3' in a compressor employing the orbiting scroll member 3 shown in FIG. 13, the back clearance $\delta_h$ is determined as follows.

An outside diameter $D_m$, thickness $t_m$ of the wrap 3', and the depth Hf' down to the seat portion 9' of the frame 9 are given as shown in FIGS. 12 and 13. The computation is conducted in the same way as the embodiment shown in FIG. 10. The assumption of $\Delta S_1 \approx \Delta S_2 \approx 0$ concerning the radial precision of the wraps 2' and 3' of both scroll members 2, 3 applies also in this computation. The actual values are as follows.

$$\Delta\epsilon = 40\ \mu m$$

$$D_m = 100\ mm$$

$$h_m' = 2 \times 40 = 80\ mm$$

Therefore, from the relationship of $\delta_h < \Delta\epsilon \cdot D_m / h_m$, the following result is obtained.

$$\delta_h < 0.04 \times 100/80$$

Therefore, it is derived that the following condition should be met.

$\delta_h < 0.05$ mm

Thus, it is understood that the mutual contact between both scroll wraps 2, 3 can be avoided by selecting the back clearance $\delta_h$ to be smaller than 50 $\mu$m.

Assuming here that the back clearance $\delta_h$ is 40 $\mu$m and that the thickness $H_s$ of the end plate 22 is 10 mm, the depth Hf' of the frame 9 is calculated to be Hf' = 10.04 mm.

As will be clearly understood from the results of the computations explained in connection with the embodiments shown in FIG. 9 and FIG. 13, it is necessary to reduce the back clearance $\delta_h$ as the wrap height $h_m$ is increased. More specifically, the back clearance $\delta_h$ is determined to be as small as the bearing clearance.

A dimensionless value $\delta_h^*$ of the back clearance $\delta_h$ is defined as follows.

$$\delta_h^* = \delta_h / D_m \quad (15)$$

According to the invention, the dimensionless value $\delta_h^*$ of the back clearance $\delta_h$ preferably satisfies the following condition.

$$\delta_h^* \leqq 1.0 \times 10^{-3} \quad (16)$$

For information, in the embodiment shown in FIG. 10, the dimensionless value $\delta_h^*$ is calculated to be $0.6 \times 10^{-3}$, while in the embodiment shown in FIG. 13 the dimensionless value $\delta_h^*$ is $0.4 \times 10^{-3}$.

An explanation will be made hereinunder as to how the performance of the compressor is affected by the dimensionless value $\delta_h^*$ of the back clearance $\delta_h$. As will be clearly understood from the foregoing description, an increase in the back clearance $\delta_h$ causes an increase in the amount $\Delta r_m$ of radial displacement of the wrap 3' of the orbiting scroll member 3, tending to allow the undesirable mutual contact between the side faces of the wraps 2', 3' of the scroll members 2, 3. In order to avoid such a contact, it is necessary to increase the amount $\Delta\epsilon$ of offset of the main shaft as given by formula (1), in proportion to the size of the back clearance $\delta_h$.

Figure 14:
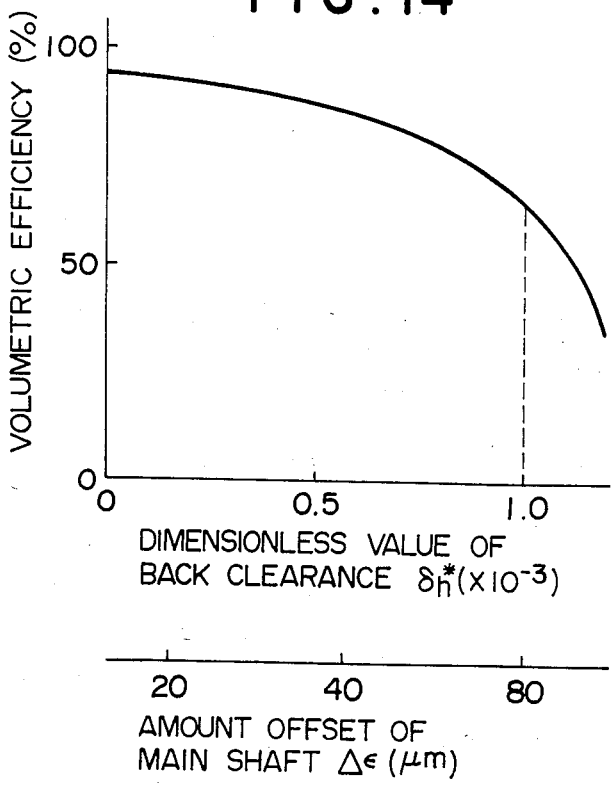
FIG. 14 is a graph showing the relationship between the dimensionless back clearance and the volumetric efficiency.

FIG. 14 shows how the performance of the compressor is affected by the dimensionless value $\delta_h^*$ of the back clearance, on the basis of the practical values of sizes as used before in connection with the embodiment of FIG. 10.

When the value $\delta_h^*$ meets the condition of $\delta_h^* > 1.0 \times 10^{-3}$, the volumetric efficiency is seriously decreased due to an increase in the internal leak. It is, therefore, preferred that the condition of $\delta_h^* \leqq 1.0 \times 10^{-3}$ is met as much as possible.

The scroll-type fluid machine of the invention is suitable for use as an air compressor, a compressor for air conditioner or the like. When the machine of the present invention is used as the compressor for air conditioner which suffers from a comparatively large internal leak of the fluid, preferably, from a practical point of view to further decrease the dimensionless value $\delta_h^*$ to meet the condition of $\delta_h^* \leqq 0.6 \times 10^{-3}$.

Figure 15:
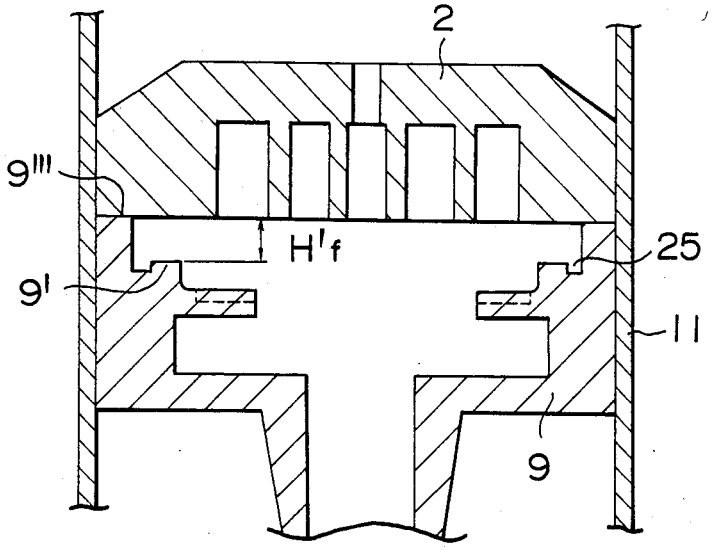
FIG. 15 is a vertical sectional view of illustrating another positional relationship between the stationary scroll member and the frame.

In the embodiment of an FIG. 15, annular recess 25 is formed in the periphery of the seat portion 9' provided by the frame 9, so that the recess 25 functions as a pool for a lubricating oil. In this embodiment, since the back clearance $\delta_h$ serves as a bearing clearance, it is possible to positively lubricate the sliding portions on the seat portion 9' provided by the frame 9 and the opposing rear surface of the end plate 22 of the orbiting scroll member 3, by supplying the lubricating oil through the annular recess 25.

As shown in FIG. 15, the frame 9 inclues a top surface 9''' which contacts with the end plate 22' of the stationary scroll member 2. The back clearance $\delta_h$ of this embodiment is determined to meet the condition of:

$$\delta h = Hf - Hs \quad (17)$$

where,

Hf': depth down from top surface to seat portion of frame, and

Hs: thickness of peripheral portion of end plate of orbiting scroll member

Figure 16:
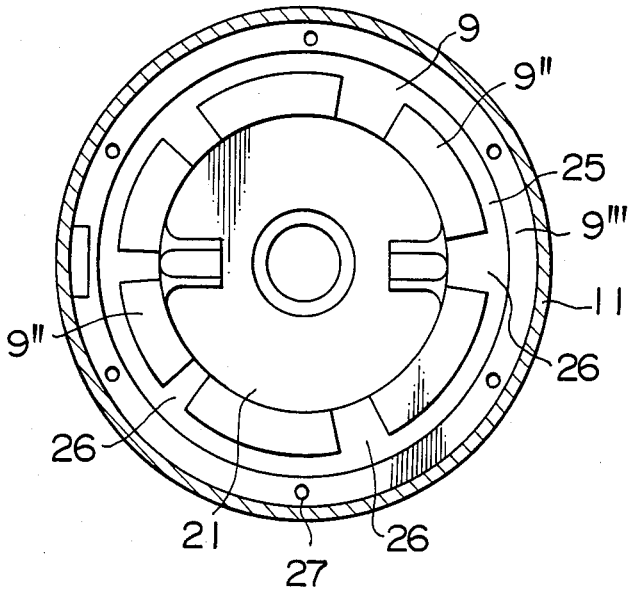
FIG. 16 is a plan view of the frame.
Figure 17:
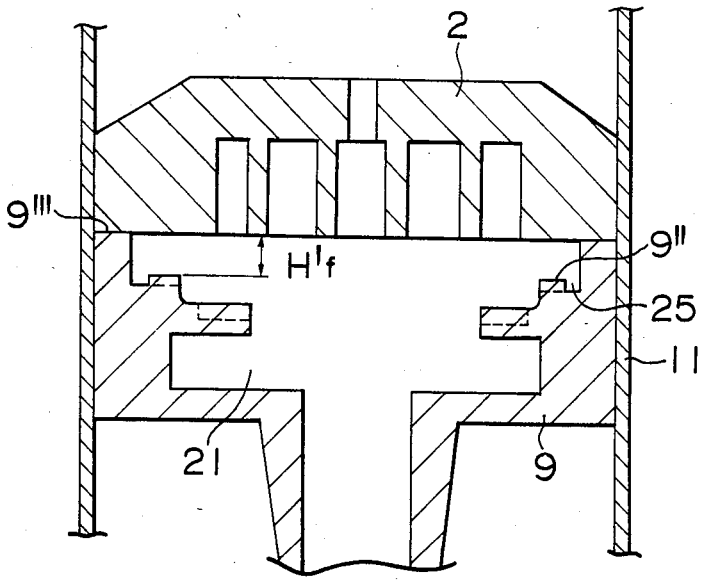
FIG. 17 is a vertical sectional view corresponding to FIG. 15 but showing a different embodiment.

In the embodiment of FIGS. 16 and 17, the frame 9 is provided with a plurality of sector-shaped seat portions 9'' (six seat portions in the illustrated case) which are arranged on a circle so as to be overlain by the orbiting scroll member 3 regardless of the displacement of the latter.

The annular recess 25 is formed at the outer side of the seat portions 9'', with the annular recess 25 communicating with the back pressure chamber 21 through a plurality of radial grooves 26 forming passages for the lubricating oil which is supplied from the recess 25 to the back pressure chamber 21 and vice versa, to facilitate the movement of the lubricating oil. Bolt holes 27 are provided for receiving bolts (not shown) for fixing the stationary scroll member 2.

Figure 18:
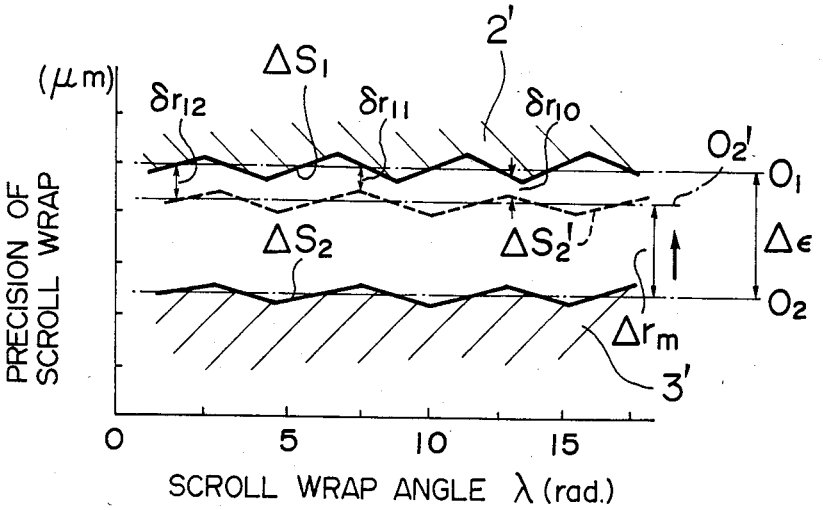
FIG. 18 is a graph corresponding to FIG. 5.

FIG. 18 is an illustration corresponding to FIG. 5, showing the change in the radial clearance $\delta_{rm}$ between the wraps 2', 3' of the scroll members 2, 3 in the scroll-type fluid machine of the invention.

In FIG. 18, $\Delta S_2'$ represents the apparent or seeming radial precision of the orbiting scroll member 3 and axis $O_2'$ represents the apparent theoretical precision of the side surface of the wrap of the orbiting scroll member 3, taking into account the radial displacement $\Delta_{rm}$ of the wrap 3' (distance between axes $O_2$ and $O_2'$ in Figure) as a result of the axial displacement $W_m$. The values of the radial clearance $\delta_{rm}$ are indicated by $\delta_{r10}$, $\delta_{r11}$ and $\delta_{r12}$.

Figure 19:
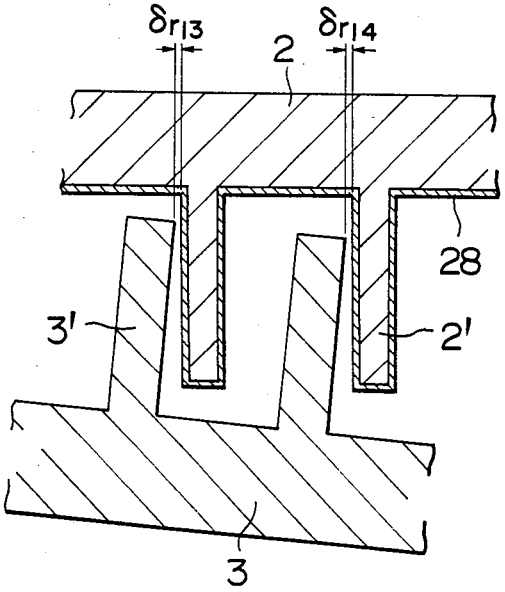
FIGS. 19, 20 and 21 are vertical sectional views of different examples of stationary scroll members.
Figure 20:
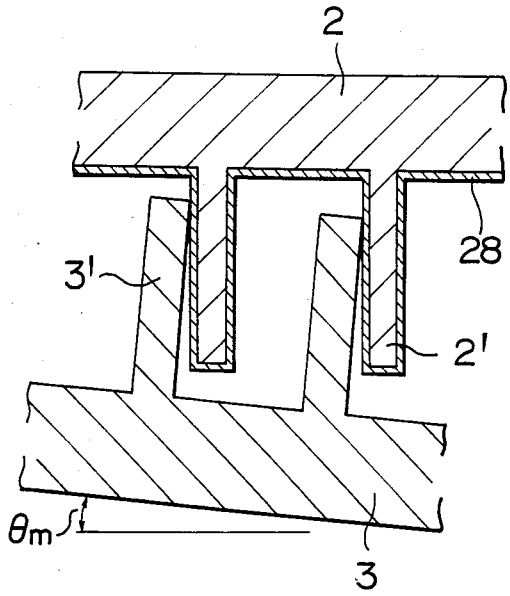
Figure 21:
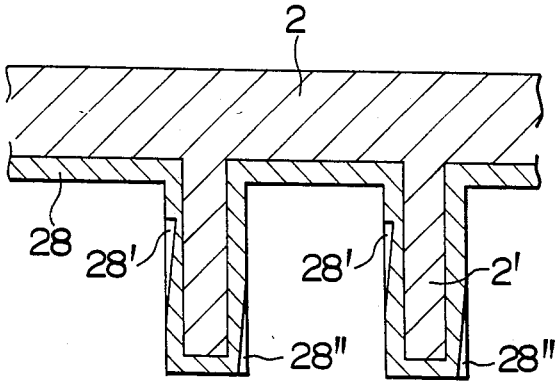

In the embodiment of FIGS. 19 to 21, a soft layer 28 is formed on the surface of the wraps 2' of the stationary scroll member 2. It will be seen that radial clearances $\delta_{r13}$ and $\delta_{r14}$ exist between the scroll wraps 2', 3' despite the soft layer 28 or affinity layer 28 on either one of the scroll wraps 2', 3'.

In the embodiment of FIG. 20, the side surface of the wrap 3' of the orbiting scroll member 3 contacts the soft layer 28. In this embodiment, the base portions of the wraps 2', 3' of the scroll members 2, 3, which are usually made of a hard metal, do not contact each other, although the soft layer 28 is ground to leave recesses 28', 28'' as shown in FIG. 21, as a result of the sliding contact by the wrap 3' of the orbiting scroll member 3. Thus, it is possible to prevent the base metals of both scroll wraps from contacting each other even when the soft layer 28 is ground.

In the embodiments of the scroll wraps 2', 3' shown in FIGS. 19 to 21 or another arrangement in which the soft affinity layer 28 is formed on the entire area of the end plate 22, the requirements for radial clearance $\delta_r$ according to the invention applies to the base metals constituting the scroll members 2, 3 and wraps 2', 3'.

The soft layer in these embodiments is a layer made of a resinous material which is worn easily such as a fluororesin. The soft layer may be a lubrite layer which is formed by a lubrite treatment, or may be a sulfide layer. From a practical point of view, the soft layer preferably has a thickness of between 50 and 200 $\mu$m.

What is claimed is:

1. A scroll-type fluid machine including a stationary scroll member and an orbiting scroll member each having a disc-like end plate and a spiral wrap protruding axially from one side of said end plate, said orbiting scroll member being disposed between the end plate of said stationary scroll member and a frame of said machine such that the wraps of said scroll members mesh with each other to define therebetween closed compression chambers and a back clearance is provided between the other side of the end plate of said orbiting scroll member and an opposing surface of said frame, the end plate of said stationary scroll member having a suction port and a discharge port formed in a peripheral portion and central portion thereof, said orbiting scroll member being dapted to be driven to make an orbiting movement with respect to said stationary scroll member without rotating about its own axis so that said compression chambers are progressively moved toward the center of said scroll members while decreasing their volumes to thereby draw a fluid through said suction port and compress the same to discharge the compressed fluid through said discharge port, wherein the improvement comprises a radial clearance $\delta_{rm}$ between said wraps of both scroll members, which radial clearance meets one of the following conditions:

$$\delta_{rm}=\Delta\epsilon\pm\Delta S_1\pm\Delta S_2-\Delta r_m>0$$

$$\delta_{rm}=\Delta\epsilon-\Delta r_m>0$$

wherein:

$\Delta\epsilon$: amount of offset of main shaft $\Delta S_1$: radial precision of wrap of stationary scroll member $\Delta S_2$: radial precision of wrap of orbiting scoll member $\Delta r_m$: radial displacement of wrap due to inclination of orbiting scroll member, whereby a clearance between opposing side surfaces of the wraps of both scroll members is preserved for avoiding mutual contact thereof even when said orbiting scroll member is inclined with respect to said stationary scroll member, and wherein, in order for said radial clearance to satisfy one of said conditions, a back clearance $\delta_h$ at the peripheral portion of the end plate of said orbiting scroll member is determined to satisfy one of the following conditions:

$$\delta_h<(\Delta\epsilon\pm\Delta S_1\pm\Delta S_2)D_m/h_m$$

and $$\delta_h<\Delta\epsilon\cdot D_m/h_m$$

wherein, $D_m$: outside diameter of end plate of orbiting scroll member $h_m$: height of scroll wrap.

2. A scroll-type fluid machine according to claim 1, wherein the dimensionless value $\delta_h^*$ of said back clearance at the peripheral portion of the end plate of said orbiting scroll member meets the condition of:

$$\delta_h^*\leqq 1.0\times 10^{-3}$$

where, $\delta_h^*$: $\delta_h/D_m$ $\delta_h$: back clearance $D_m$: outside diameter of end plate of orbiting scroll member.

3. A scroll-type fluid machine according to claim 2, wherein said dimensionless value $\delta_h^*$ meets the condition of $\delta_h^*\leqq 0.6\times 10^{-3}$.

* * * * *